US010940962B2

(12) United States Patent
Draier

(10) Patent No.: US 10,940,962 B2
(45) Date of Patent: Mar. 9, 2021

(54) DEVICE FOR PRODUCING A TUBULAR CONTAINER

(71) Applicant: TOPOCARE GMBH, Gutersloh (DE)

(72) Inventor: Roland Draier, Gütersloh (DE)

(73) Assignee: TOPOCARE GMBH, Gütersloh (DE)

( * ) Notice: Subject to any disclaimer, the term of this patent is extended or adjusted under 35 U.S.C. 154(b) by 103 days.

(21) Appl. No.: 16/313,183

(22) PCT Filed: Jun. 30, 2016

(86) PCT No.: PCT/EP2016/065443
§ 371 (c)(1),
(2) Date: Dec. 26, 2018

(87) PCT Pub. No.: WO2018/001501
PCT Pub. Date: Jan. 4, 2018

(65) Prior Publication Data

US 2019/0144145 A1 May 16, 2019

(51) Int. Cl.
*B65B 9/00* (2006.01)
*B65B 1/02* (2006.01)
(Continued)

(52) U.S. Cl.
CPC ..... *B65B 1/02* (2013.01); *B65B 1/04* (2013.01); *B65B 9/023* (2013.01); *B65B 9/06* (2013.01);
(Continued)

(58) Field of Classification Search
CPC .. B65B 9/06; B65B 9/067; B65B 1/02; B65B 1/04; B65B 1/06; B65B 9/20;
(Continued)

(56) References Cited

U.S. PATENT DOCUMENTS 2,894,362 A * 7/1959 Cargill ..... B65B 9/06 53/550
3,532,516 A * 10/1970 Erekson ..... B65B 9/06 53/450
(Continued)

FOREIGN PATENT DOCUMENTS

WO 2010142298 A1 12/2010
WO WO-2010142298 A1 * 12/2010 ..... B65B 1/12

OTHER PUBLICATIONS

International Search Report (dated Mar. 8, 2017) for corresponding International App. PCT/EP2016/065443.

*Primary Examiner* — Andrew M Tecco
*Assistant Examiner* — Eyamindae C Jallow
(74) *Attorney, Agent, or Firm* — WRB-IP LLP

(57) ABSTRACT

A device is provided for producing a tubular container which is able to be filled with granular, pulverulent, pourable and flowable materials, wherein the container can include webs manufactured from geotextile material. The device includes a displaceable frame with at least one unwindable geotextile web, wherein the frame includes a filling trough with an outlet hopper for the material, and wherein the filling trough has a conveying device for the filled material, the conveying device acting counter to the direction of movement of the frame, which, at the rear end of the filling trough, surrounds the material in an enveloping manner, in the region of the outlet hopper, by the unwindable geotextile web, as the frame is advanced, so as to form a tube.

13 Claims, 7 Drawing Sheets

(51) Int. Cl.

| | |
|---|---|
| ***B65B 1/04*** | (2006.01) |
| ***B65B 9/02*** | (2006.01) |
| ***B65B 9/06*** | (2012.01) |
| ***B65B 9/13*** | (2006.01) |
| ***E02D 17/18*** | (2006.01) |
| ***B65B 43/54*** | (2006.01) |
| ***E02B 3/12*** | (2006.01) |
| ***B65B 41/12*** | (2006.01) |
| ***E02B 3/10*** | (2006.01) |
| ***E02D 17/20*** | (2006.01) |

(52) U.S. Cl.
CPC ..... *B65B 9/13* (2013.01); *B65B 41/12* (2013.01); *B65B 43/54* (2013.01); *E02B 3/108* (2013.01); *E02B 3/127* (2013.01); *E02B 3/128* (2013.01); *E02D 17/18* (2013.01); *E02D 17/202* (2013.01); *E02D 2200/1685* (2013.01); *E02D 2250/00* (2013.01); *E02D 2300/0085* (2013.01)

(58) Field of Classification Search
CPC ... B65B 9/2014; B65B 9/2035; B65B 9/2056; B65B 9/207; B65B 9/22
USPC ..... 53/450, 451, 550, 551
See application file for complete search history.

(56) References Cited

U.S. PATENT DOCUMENTS

| | | | | | |
|---|---|---|---|---|---|
| 3,581,457 | A * | 6/1971 | Gerlach | B65B 9/06 | 53/450 |
| 4,090,342 | A * | 5/1978 | Rishel | B65B 9/06 | 102/324 |
| 4,722,168 | A * | 2/1988 | Heaney | B65B 57/14 | 53/450 |
| 4,820,110 | A * | 4/1989 | Efird | B60P 1/6481 | 414/458 |
| 5,425,403 | A * | 6/1995 | Herrmann | B65B 1/12 | 141/114 |
| 5,491,960 | A | 2/1996 | Taylor, Jr. | | |
| 5,564,261 | A * | 10/1996 | Kiner | B65B 63/026 | 53/439 |
| 5,893,260 | A * | 4/1999 | McKenna | B65B 1/12 | 53/451 |
| 5,901,762 | A * | 5/1999 | Rollins | B65B 1/12 | 141/231 |
| 9,139,318 | B2 * | 9/2015 | Lee | B65B 9/067 | |
| 9,561,874 | B2 | 2/2017 | Draier | | |
| 2004/0128953 | A1 * | 7/2004 | Cullen | A01F 25/183 | 53/459 |
| 2011/0011037 | A1 | 1/2011 | Kean | | |

* cited by examiner

DEVICE FOR PRODUCING A TUBULAR CONTAINER

BACKGROUND AND SUMMARY

The invention relates to a device for producing a tubular container which is able to be filled with granular, pulverulent, pourable materials, wherein the container preferably consists of or comprises a web manufactured from geotextile material.

Tubes manufactured from geotextile material which are preferably filled with sand, but also with gravel, crushed stone, earth materials, or similar building materials, are of particular use for the erection of embankments, e.g. protective structures such as levees, noise embankments, etc. As such, the geotextile material has sufficient strength to retain granular materials within a matrix, wherein the geotextile may be permeable or impermeable to water. Thus, tubes manufactured in this manner may be advantageously employed in the construction of dams, where, in addition to the formation of permanent structures, they can be used to repair dams and erect temporary structures. A dam formed with such tubes has a high stability, the tubes in particular withstanding flooding of the dam.

As such, a device for filling tubes manufactured form geotextile material is known from DE 20 2010 008 093 U1. The device described in the prior art comprises a tubular housing in cooperation with an unwinding device on which the geotextile material is provisioned. Through the tubular housing, the pourable material is then supplied in a continuous process, so that as a result of unwinding the geotextile material a filled tube is formed.

Such a prior-art device has disadvantages in that it provides a very complex construction and is only suitable for machine laying of filled geotextile tubes. With the known device, the filling process requires a complex infrastructure of vehicles and conveying devices in order to ensure a continuous laying and filling operation of the tubes. However, it is often demanded that tubes be formed particularly quickly and without major provision of infrastructure to thereby obtain a barrier or embankment which is to be built directly on site.

Therefore, an aspect of the invention addresses the problem of providing a device for producing a tubular container which is immediately and quickly operational, wherein the device is to be more light-weight and less costly when it comes to construction and transport volume.

The advantages achieved with an aspect of the invention are now that the device according to the invention is lightweight and easy to handle in that it can be readily and quickly deployed on site wherever a filled geotextile tube is to be formed, for example. The device now offers the possibility that a tubular container can be formed quickly and readily by filling the displaceable frame of the device in conjunction with the stored geotextile material. As such, the device is pulled by its own drive or by a traction unit, wherein a simple filling of the material into the filling trough may also be accomplished using a shovel loader. When displacing the device, the filled tube is formed by the advancement, the tube being laid by the device such that a geotextile web from below, on the one hand, and a geotextile web from above form the enclosed tube for the material. As such, the closing of the geotextile web by the edge zones is preferably achieved by overlapping them around the first geotextile web, wherein the bond underneath the tube is created by the self-weight of the overlying material.

According to an aspect of the invention, it is suggested in this respect that the device consists of or comprises a displaceable frame with at least one unwindable geotextile web, wherein the frame comprises a filling trough with an outlet hopper for the material, and wherein the filling trough has a conveying device for the filled material, said conveying device acting counter to the direction of movement of the frame, which, at the rear end of the filling trough, surrounds the material in an enveloping manner, in the region of the outlet hopper, by means of the unwindable geotextile web, as the frame is advanced, so as to form a tube. As such, according to a first embodiment, the conveying device may comprise an additional geotextile web unwindable at the front end of the filling trough. This web is loaded into and guided within the filling trough as the frame is advanced. Due to the movement of the frame, the overlaying or filled material is discharged counter to the advancing movement of the frame.

However, the conveying device may also comprise an endless belt disposed at the trough bottom or a cylinder disposed within the filling trough, wherein the endless belt discharges the overlaying material in a relative movement to the frame which is moved forward, wherein the material is discharged from the frame counter to the advancing movement. A cylinder disposed within the filling trough will then press the material out of the frame counter to the advancing movement.

The device, and here particularly the filling trough present on the frame with two geotextile webs, has, at its front end, a loading zone for the first unwindable geotextile web which is fixed prior to starting the device with its free end at the starting point of laying the tube. When displacing the frame, the fixed geotextile web is then dragged through the inner filling trough zone, the web unfolding either at the bottom or such that the geotextile abuts on the walls of the trough and is spread, for example, if the geotextile web is provisioned in a folded state. In this case, a tensioning element in the form of a net may be incorporated between the edges of the web which ensures sufficient dimensional stability of the round shape of the tube in the tube's diametral axis. As such, the geotextile web is guided on the trough bottom during advancement of the frame and is quasi-stationary with respect to the laying environment, since the frame is pulled out from under the geotextile web along with the material, so that discharge is accomplished at the end of the frame. At the rear end of the filling trough, the loading zone for the second unwindable geotextile web is provided, surrounding the material filled onto the first unwound geotextile web in an enveloping manner upon advancement to form a tube.

As such, according to a particularly advantageous design, as a result of the advancement, i.e., the continuous process, the material on the first geotextile web is able to be formed into a circular cross-section within the outlet hopper. Here, the outlet hopper cooperates with a dosing device in the form of a slider, defining the diametral size of the tube to be formed by pushing excess material back into the filling trough. Accordingly, in order to lay different tube diameters, the relevant widths of geotextile web are then used. Upon advancement of the frame, the edge zones of the second unwound geotextile web are guided on the outside along the hopper walls of the outlet hopper such that the edge zones lie overlapping underneath the unwound geotextile web with the material to form the filled tube. Thus, it should be understood that the material introduced into the filling trough is conveyed on the first geotextile web, wherein the material is formed into a round shape when exiting the filling trough at the transition to the outlet hopper, wherein the second geotextile web is then correspondingly unwound above the outlet hopper, being laid around the formed material zone due to the configuration of the outlet hopper such that the edges of the second geotextile web are joined underneath the outlet hopper in an overlapping manner and are held together by the self-weight of the tube.

In a further development of the invention, the front loading zone substantially consists of or comprises an unwinding axis for the geotextile web and a vertical or horizontal slot at the front of the filling trough. Thus, the geotextile web can be introduced into the trough zone through this slot, wherein a folded geotextile web unwindably stored on the unwinding axis can be unfolded such that one half portion of the web comes to lie and is guided against the one wall and the other half portion against the other wall of the filling trough, respectively. In this respect, the vertical slot in the front of the filling trough is intended for the folded geotextile web. Then, the pourable material is applied onto the unfolded geotextile web and then conveyed by the movement of the frame on the first geotextile web to the discharge zone.

According to a particularly advantageous further development, the rear loading zone consists of or comprises an unwinding axis for the second geotextile web, which is horizontally disposed above the outlet hopper, and a guiding device for the edges of the second geotextile web, which is disposed at the outer wall of the outlet hopper. The unwinding process is accomplished such that the edges drag along the outer walls of the outlet upper during movement of the frame in such a manner that the guiding device comprises two converging tracks bent opposite each other along the outer wall of the outlet hopper towards the discharge, enabling the layers of both edges of the second geotextile to overlay each other underneath the hopper outlet towards the discharge.

According to a particularly advantageous design of an aspect of the invention, the track may be configured as a gate for receiving the web edge. There is also the possibility that the track consists of or comprises roller holders in which portions of the web edge are held. In this case, in order to be guided in the tracks of the guiding device, the edges of the geotextile webs may be provided with so-called stabilizers such as guide strips, string rods or the like which are here enclosed in folded pockets at the web edge. This configuration creates a bead at the edge material which, in this case, can be guided in the gates, but also in the roller holders.

According to a particularly advantageous further development, as already detailed above, the first geotextile web is provided with a tensioning element which is tensioned between the edges of the geotextile web during filling. When displacing the frame, the geotextile web is dragged into the inner filling trough zone, the web unfolding either at the bottom or such that the geotextile abuts on the walls of the trough and is spread, for example, if the geotextile web is provisioned in a folded state. In this case, the tensioning element in the form of a net may be incorporated between the edges of the web which ensures sufficient dimensional stability of the round shape of the tube in the diametral axis of the laid filled tube.

In a further development of an aspect of the invention, the frame is provided with its own drive. As an example, this drive may comprise a crawler track which may be disposed with a universal joint or ball joint underneath the frame. This configuration ensures the maneuverability of the device so that the tube can be laid in any direction. Another development of the displaceable frame can be designed such that the frame is configured as a trailer which may cooperate with a traction unit. In this case, the frame has an axle disposed with balloon wheels underneath the outlet hopper. The structure of the device enables the device to be moved over tubes already laid such that tubes may be accordingly laid one above the other in this case.

BRIEF DESCRIPTION OF THE DRAWINGS

An exemplary embodiment of an aspect of the invention is purely schematically shown in the drawings and is described below in greater detail. In the figures.

DETAILED DESCRIPTION

Figure 1:
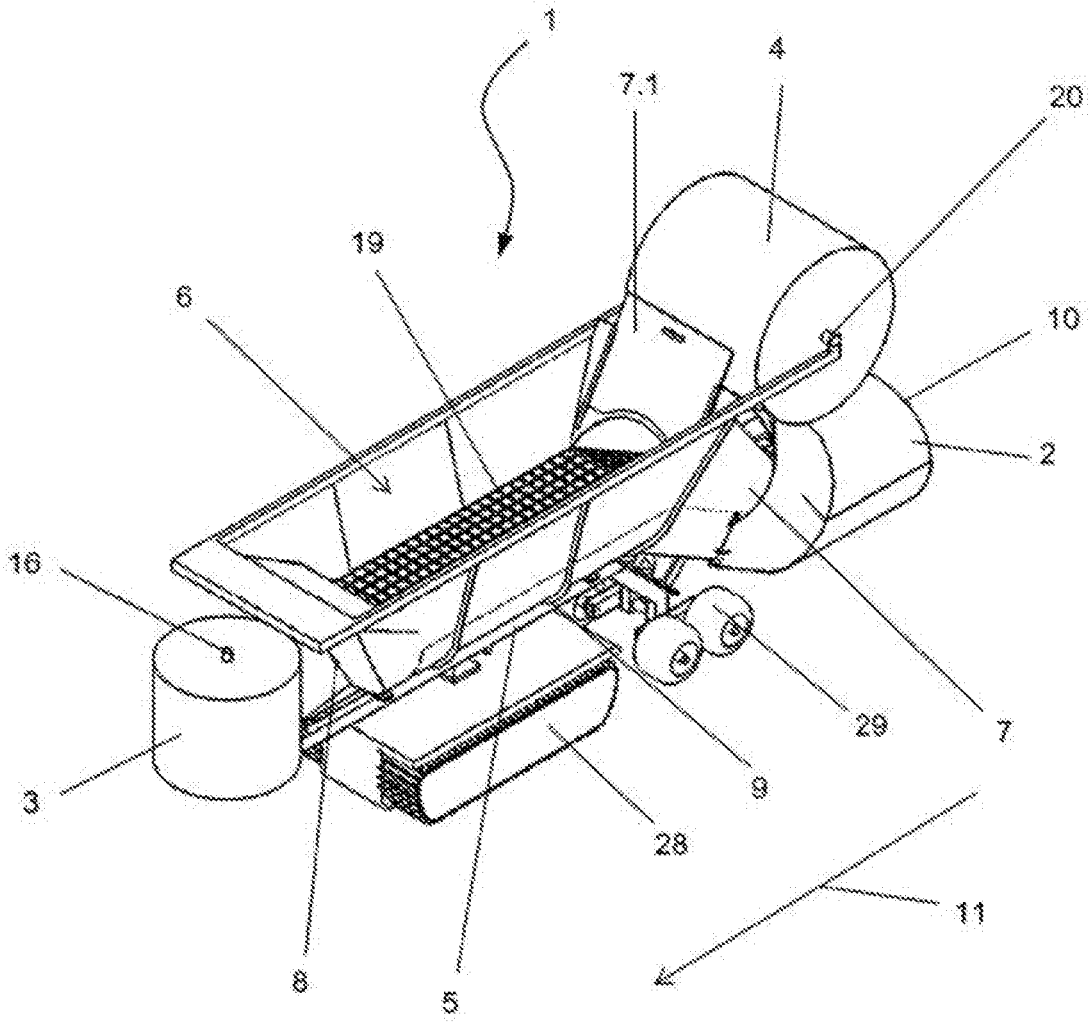
FIG. 1 shows a perspective view of the device according to an aspect of the invention.
Figure 2:
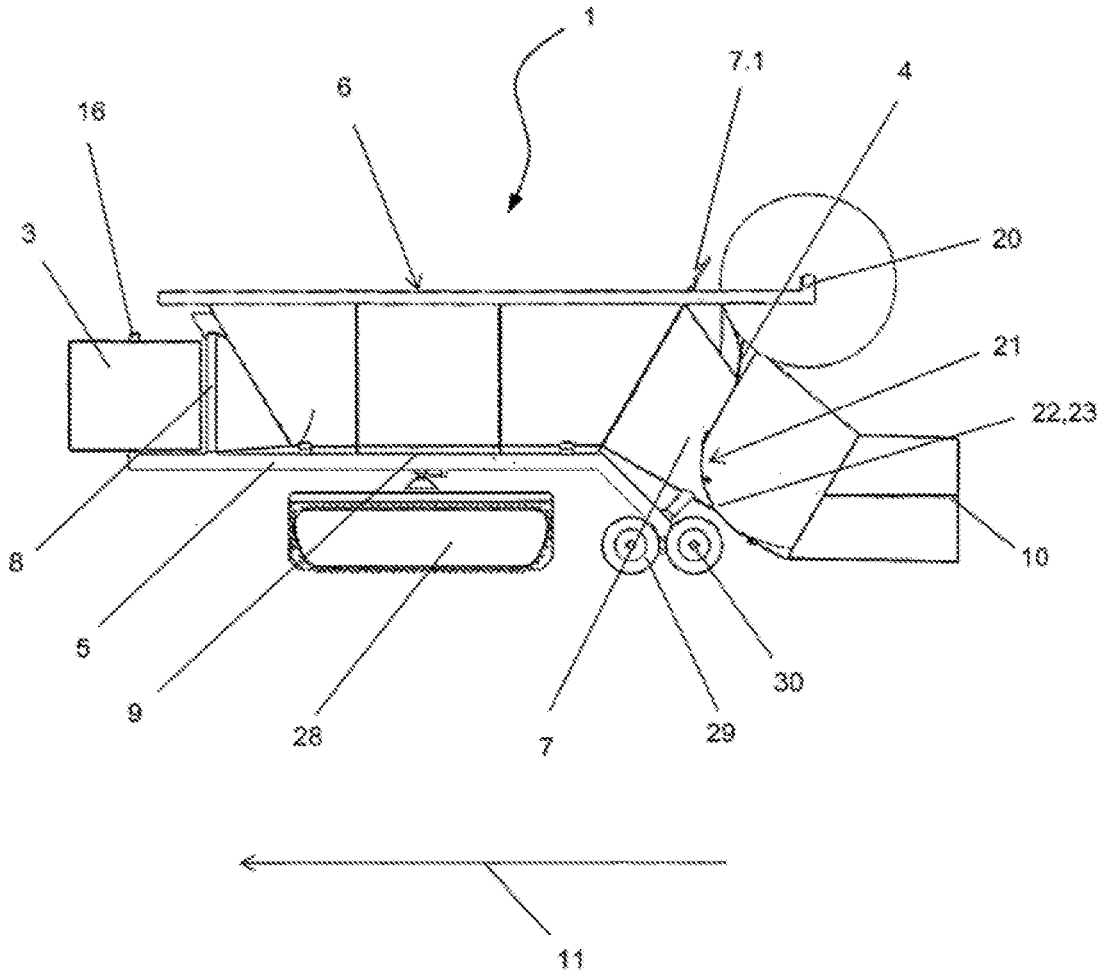
FIG. 2 shows a side view of the device of FIG. 1.
Figure 3:
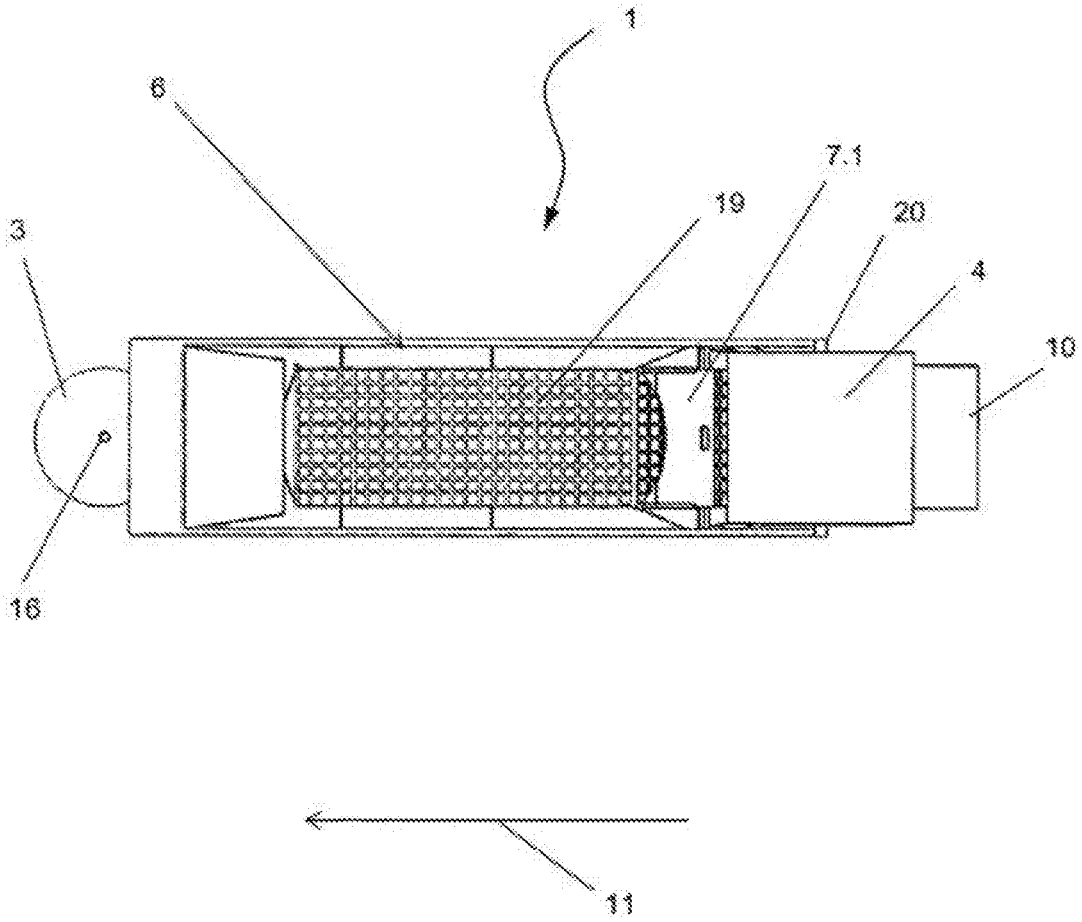
FIG. 3 shows a plan view of the device of FIG. 1.

FIGS. 1, 2, and 3 show an embodiment of a device 1 for producing a tubular container 2, as indicated in FIG. 2. In this case, container 2 consists of or comprises a granular, pulverulent, pourable or flowable material which, in the example shown, is surrounded by webs 3 and 4 manufactured from geotextile material.

As can best be recognized when looking at FIGS. 1 and 2 together, device 1 consists of or comprises a displaceable frame 5 having a filling trough 6 for the material. At its rear end, filling trough 6 has an outlet hopper 7 for the material, wherein, at the front end, a first loading zone 8 is provided for a first unwindable geotextile web 3, which is guided on a trough bottom 9 as frame 5 is advanced.

Figure 6:
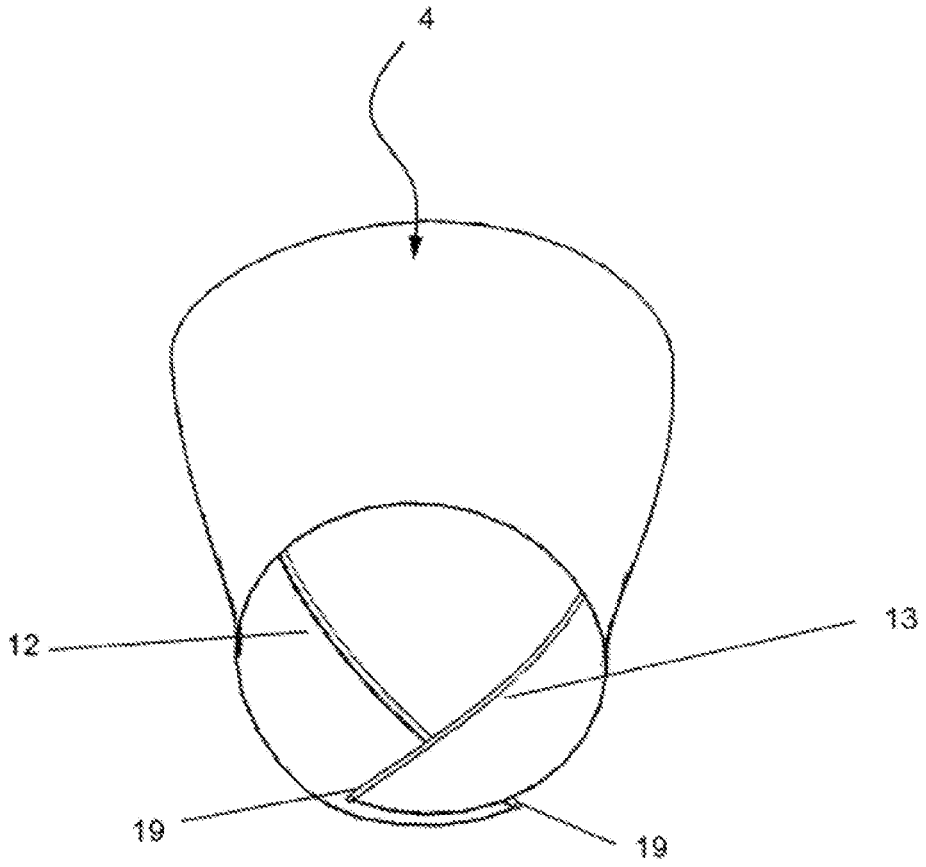
FIG. 6 shows a detail view of the second geotextile web with an overlapping region.
Figure 7:
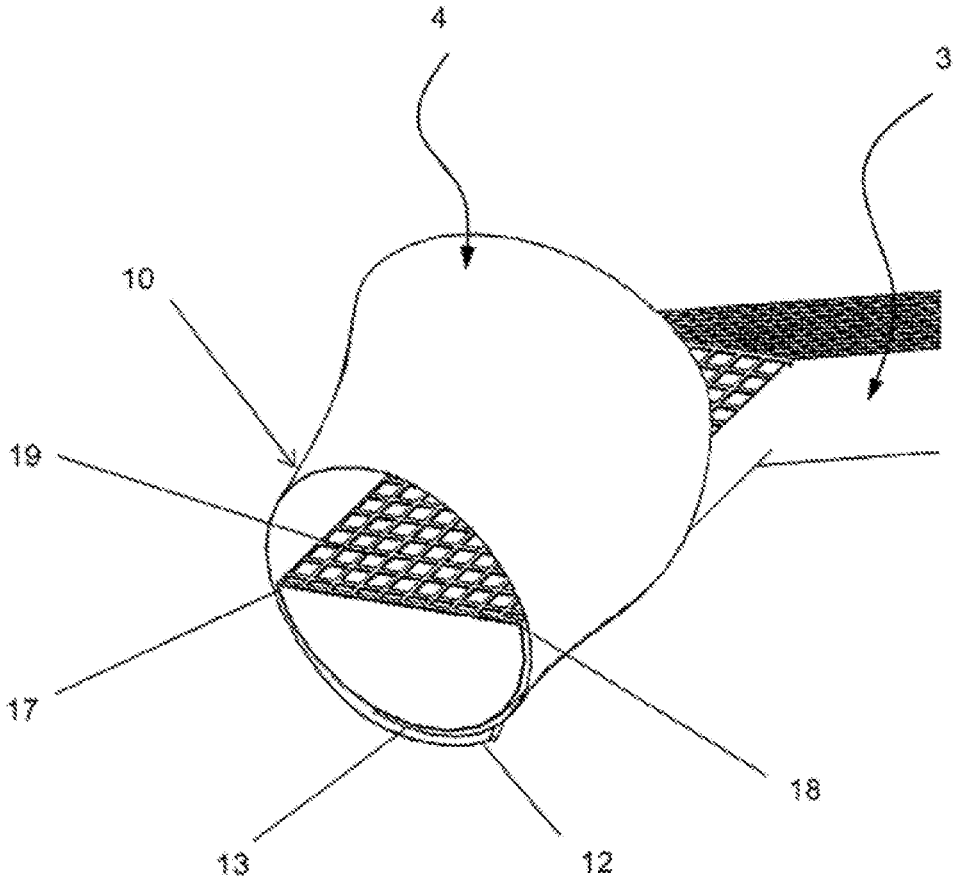
FIG. 7 shows another detail view of the first geotextile web in cooperation with the second geotextile web.

At the rear end of filling trough 6, a second loading zone for a second unwindable geotextile web 4 is provided, surrounding the material filled onto the first unwound geotextile web 3 in an enveloping manner upon advancement to form a tube 10, as shown in FIG. 2 in a side view. Due to the advancement according to arrow direction 11, the material on the first geotextile web 3 is formed into a circular cross-section within outlet hopper 7, wherein, upon advancement of frame 5, edge zones 12 and 13 of second unwound geotextile web 4 are guided on the outside of hopper walls 14 and 15 of outlet hopper 7 such that edge zones 12 and 13 come to lie in an overlapping manner, as shown in FIG. 6, underneath first unwound geotextile web 3 with the material to form filled tube 10 according to FIG. 2 and FIG. 7. As such, according to a particularly advantageous design, as a result of the advancement, i.e. the continuous process, the material on first geotextile web 3 is able to be formed into a circular cross-section within outlet hopper 7. Here, outlet hopper 7 cooperates with a dosing device 7.1 in the form of a slider defining the diametral size of tube 10 to be formed by pushing excess material back into filling trough 6. Accordingly, in order to lay different tube diameters, the relevant widths of geotextile web 4 are then used.

As can best be recognized from FIGS. 1 and 3, in this case, the front loading zone substantially consists of or comprises an unwinding axis 16 for geotextile web 3 and a vertical or horizontal slot at the front of filling trough 6, which is not shown in greater detail. As set out previously, as such, geotextile web 3 may be introduced such that it is provisioned on unwinding axis 16 in the folded state. This means that, when introduced into filling trough 6, geotextile web 3 is unfolded such that, in this case, filling trough 6 is provided with brackets or legs unfolding folded geotextile web 3 in such a manner that the respective subportions of folded geotextile web 3 are laid against the wall zones of filling trough 6, wherein a tensioning element 19 in the form of a net is deployed between edges 17 and 18 of first geotextile web 3, as is apparent from FIG. 7.

When the material is then filled onto unfolded geotextile web 3 through the net, geotextile web 3 comes to lie within filling trough 6. If frame 5 is now displaced according to arrow direction 11, the material filled onto geotextile web 3 moves in the direction of outlet hopper 7, at which the rear loading device is located. In this case, the latter consists of or comprises an unwinding axis 20 for second geotextile web 4, which is horizontally disposed above outlet hopper 7, and a guiding device 21 for the edges or edge zones 12 and 13 of second geotextile web 4, which is disposed at the outer wall of outlet hopper 7.

Figure 4:
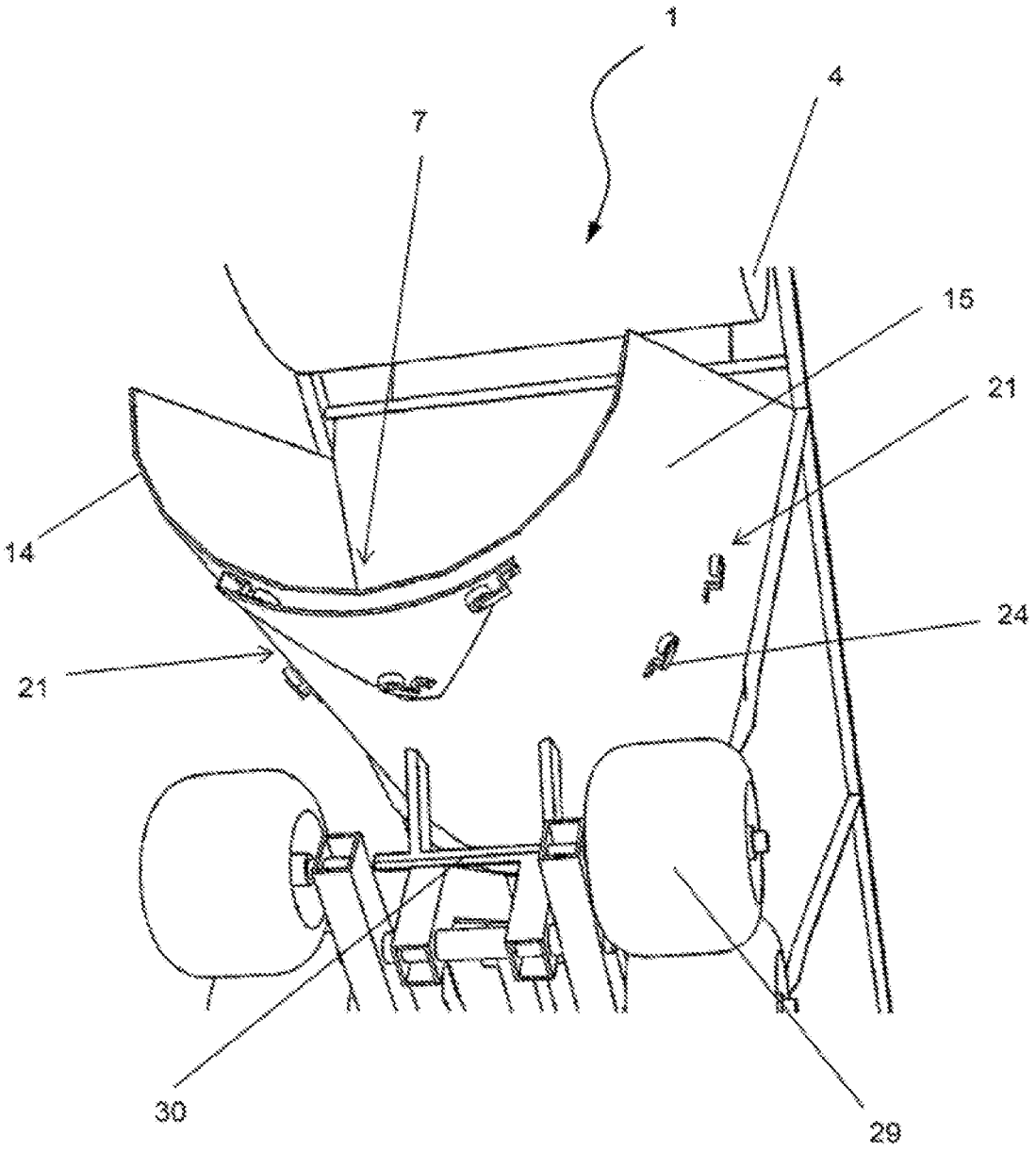
FIG. 4 shows a perspective rear view of the outlet hopper of the device of FIG. 1.
Figure 5:
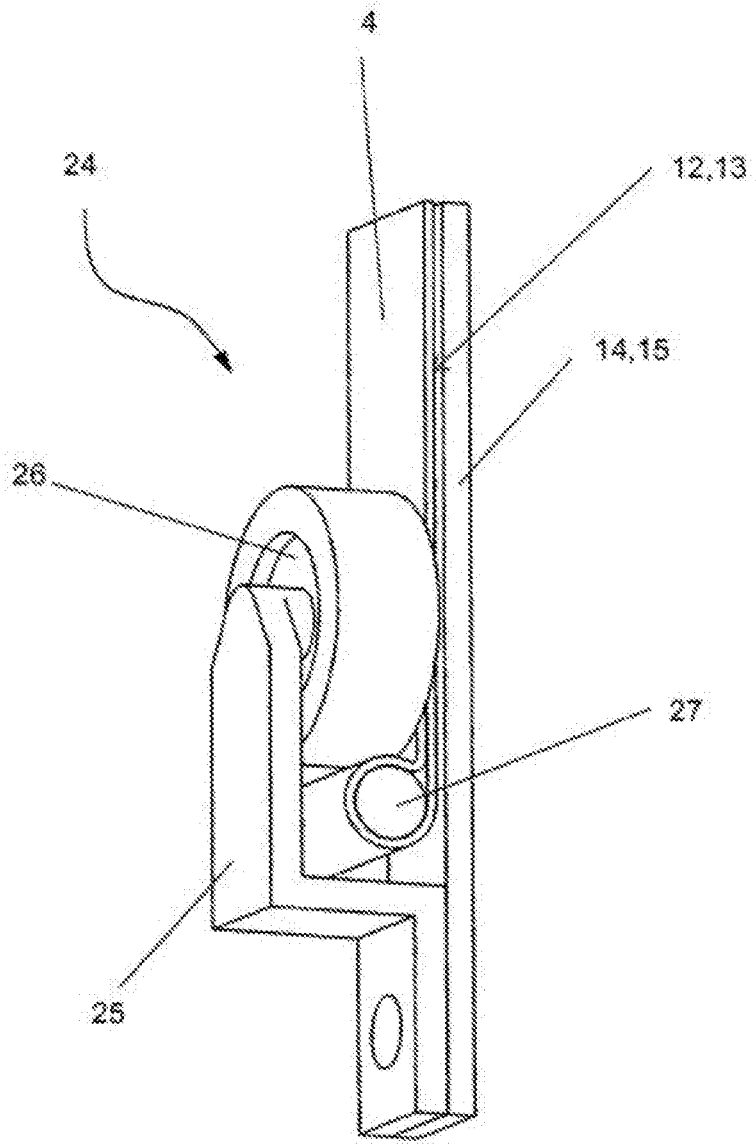
FIG. 5 shows a detail view of a roller holder on the outer wall of the outlet hopper.

As such, guiding device 21 shown in FIGS. 4 and 5 comprises two converging tracks 22 and 23 bent opposite each other along the outer wall of outlet hopper 7 towards the discharge, which are disposed underneath the hopper outlet towards the discharge, extending one above the other, as can be seen in FIGS. 2 and 4. Guide tracks 22 and 23 are shown in the form of dashed lines here. As an example, tracks 22 and 23 may be configured as a gate for receiving the web edge. In the exemplary embodiment according to FIGS. 4 and 5 described herein, tracks 22 and 23 consist of or comprises roller holders 24, as shown in the detail view of FIG. 5 in a perspective view. As such, roller holder 24 consists of or comprises an angle section 25 at the inside of which a roller 26 is disposed. In order to ensure guidance of edge zones 12 and 13 particularly in roller holder 24, the edges of geotextile webs 3, 4 are provided with stabilizers 27 for guiding them in tracks 22 and 23 of guiding device 21, wherein these stabilizers, as shown, may be guide strips, guide strings or flexible guide rods, for example.

FIGS. 6 and 7 again illustrate the forming of second geotextile web 4 with the bottom overlap of edge zones 12 and 13, wherein FIG. 7 illustrates the position of both geotextile webs 3 and 4 when joined and filled with material. Here, it becomes apparent that tensioning element 19 configured as a net is deployed in the diametral axis such that sufficient inner stability is provided in the circular cross-section of the tube and created during the forming process.

According to a particularly advantageous design of an aspect of the invention shown in FIGS. 1 and 2, frame 5 is provided with a drive 28 which is designed as a crawler track here in the present exemplary embodiment. As such, the crawler track is connected to the bottom of frame 5 by a universal or ball joint so that the crawler track has a sufficient range of movement underneath frame 5 so as to ensure off-road capability. As such, the crawler track is provided with a drive so that the direction in which tube 10 is to be laid here can be determined using a control of the individual crawler chains. Another embodiment may be that frame 5 is configured as a trailer, cooperating with a traction unit, not shown herein in detail. Because it would also be conceivable that frame 5 is displaced using a tractor. In a further development of frame 5, it has an axle 30 equipped with balloon wheels 29 underneath outlet hopper 7, so that, in particular, using device 1 tubes 10 may be laid one above the other and, thanks to balloon wheels 29, a minimum load is applied to tubes 10 already laid

LIST OF REFERENCE NUMERALS

1. Device
2. Tubular container
3. Conveying device/first geotextile web
4. Second geotextile web
5. Displaceable frame
6. Filling trough
7. Outlet hopper,
7.1 Dosing device
8. Loading zone
9. Trough bottom
10. Tube
11. Arrow direction
12. Edge zones
13. Edge zones
14. Hopper wall
15. Hopper wall
16. Unwinding axis of first web
17. Edge
18. Edge
19. Tensioning element
20. Unwinding axis
21. Guiding device
22. Web
23. Web
24. Roller holder
25. Angle section
26. Roller
27. Stabilizers
28. Drive
29. Balloon wheels
30. Axle

The invention claimed is:

1. A device for producing a tubular container which is able to be filled with granular, pulverulent, pourable and flowable materials, wherein the container comprises webs manufactured from geotextile material, the device comprising a displaceable frame adapted to be provided with at least one geotextile web that is unwindable, the frame comprising a filling trough, the filling trough comprising an outlet hopper for the material and a conveying device for the filled material, the conveying device being configured to convey the filled material in a direction counter to a direction of movement of the frame, wherein the conveying device is configured to surround the filled material in an enveloping manner at a rear end of the filling trough by the outlet hopper with the geotextile web as the frame is advanced so as to form a tube and to arrange edge zones of the geotextile web so that they are overlapped at a bottom of the tube for being bonded by weight of the filled material.

2. The device according to claim 1, wherein the device is adapted to be provided with an additional geotextile web that is unwindable at a front of the filling trough, the device being configured to guide the additional geotextile web within the filling trough as the frame is advanced and the filled material is conveyed in the direction counter to the direction of movement of the frame.

3. The device according to claim 2, wherein the device is configured such that due to advancement of the frame, the material on the additional geotextile web is formed into a circular cross-section within the outlet hopper by a dosing device at the outlet hopper, and, upon advancement of the frame and unwinding of the additional geotextile web, edge zones of the geotextile web are guided on an outside of walls of the hopper and of the outlet hopper such that the edge zones come to lie in an overlapping manner underneath the additional geotextile web to form the filled tube.

4. The device according to claim 2, wherein the device is configured such that the additional geotextile web cooperates with a front loading zone which comprises an unwinding axis for the additional geotextile web, and a vertical or horizontal slot at the front of the filling trough, and a guiding device for edges of the additional geotextile web disposed at inner walls of the filling trough.

5. The device according to claim 1, wherein the conveying device comprises an endless belt disposed at trough bottom or a cylinder disposed within the filling trough which discharges the material in the direction counter to the direction of movement of the frame.

6. The device according to claim 1, wherein device is configured such that the the geotextile web cooperates with a rear loading zone comprising an unwinding axis for the geotextile web, the unwinding axis being horizontal and disposed above the outlet hopper, and a guiding device for the edges and of the geotextile web, the guiding device being disposed at the outer wall of the outlet hopper.

7. The device according to claim 6, wherein the guiding device comprises two converging tracks opposite each other along the outer wall of the outlet hopper towards a discharge of the hopper, the tracks extending one above the other underneath the hopper outlet towards the discharge.

8. The device according to claim 2, wherein the tracks are configured as gates or roller holders for receiving the edge zones of the geotextile web.

9. The device according to claim 7, wherein the tracks are configured to guide stabilizers at the edge zones of the geotextile, the stabilizers including guide strips, strings, or rods.

10. The device according to claim 1, wherein the device is configured to tension a tensioning element of the geotextile web during filling.

11. The device according to claim 1, wherein the frame is provided with its own drive.

12. The device according to claim 1, wherein the frame is configured as a trailer cooperating with a traction unit.

13. The device according to claim 1, wherein the frame has an axle having balloon wheels or crawlers underneath the outlet hopper.

* * * * *